US009511977B2

(12) United States Patent
Schautt

(10) Patent No.: US 9,511,977 B2
(45) Date of Patent: Dec. 6, 2016

(54) FRICTION BRAKE HAVING AT LEAST ONE BRAKE LEVER WHICH IS MOUNTED ON A SOLID BODY JOINT

(71) Applicant: gomtec GmbH, Seefeld (DE)

(72) Inventor: Martin Schautt, Munich (DE)

(73) Assignee: gomtec GmbH, Seefeld (DE)

( * ) Notice: Subject to any disclaimer, the term of this patent is extended or adjusted under 35 U.S.C. 154(b) by 0 days.

(21) Appl. No.: 14/420,594

(22) PCT Filed: Jul. 8, 2013

(86) PCT No.: PCT/EP2013/064353
§ 371 (c)(1),
(2) Date: Feb. 9, 2015

(87) PCT Pub. No.: WO2014/023497
PCT Pub. Date: Feb. 13, 2014

(65) Prior Publication Data

US 2015/0217970 A1 Aug. 6, 2015

(30) Foreign Application Priority Data

Aug. 10, 2012 (DE) ..... 10 2012 107 362

(51) Int. Cl.
*B66B 5/18* (2006.01)
*B66B 5/24* (2006.01)

(52) U.S. Cl.
CPC .. *B66B 5/18* (2013.01); *B66B 5/24* (2013.01)

(58) Field of Classification Search
CPC ..... B66B 5/18; B66B 5/24
(Continued)

(56) References Cited

U.S. PATENT DOCUMENTS 4,234,059 A * 11/1980 Schaad ..... B61H 9/02 105/150
4,572,335 A * 2/1986 Kobelt ..... F16D 55/2245 188/72.1

(Continued)

FOREIGN PATENT DOCUMENTS

DE 2910118 A1 9/1980
DE 102011000720 A1 8/2012

(Continued)

OTHER PUBLICATIONS

Machine Translation in English for FR 2670476A1, Inventor Marion; 3 pages; Retrieve Date: Dec. 11, 2015.*
International Search Report No. PCT/EP2013/064353 dated Oct. 9, 2013.

*Primary Examiner* — Thomas J Williams
*Assistant Examiner* — Mariano Sy
(74) *Attorney, Agent, or Firm* — Carter, DeLuca, Farrell & Schmidt, LLP

(57) ABSTRACT

A friction brake (1) for braking a rail-guided transport device (26), in particular a lift (elevator), having at least one brake lever (15) with a brake lining (4), which can be pressed against a rail (2) in order to brake the transport device (26), and with an actuator (6) for actuating the at least one brake lever (15). According to the invention, a solid body joint (36) is proposed, which has at least one web (37) to which a brake lever (3) is fastened, wherein the web (37) twists about the longitudinal axis (38) thereof when the brake lever (3) performs a pivoting movement. Moreover, according to the invention, means (42, 42', 50, 52) are provided, which limit or prevent deflection of the web (37) in the lateral direction (x).

14 Claims, 9 Drawing Sheets

(58) Field of Classification Search
USPC ..... 188/190, 43, 44, 171, 173, 72.1, 72.9; 187/286, 292, 376, 359
See application file for complete search history.

(56) References Cited

U.S. PATENT DOCUMENTS 4,592,451 A * 6/1986 Persson ..... B61H 5/00 188/107
5,014,828 A * 5/1991 Baldassarre ..... B66B 5/18 187/288
5,518,087 A * 5/1996 Hwang ..... B66B 5/18 187/374
5,739,610 A * 4/1998 Nemoto ..... F16D 55/2245 188/158
6,131,704 A * 10/2000 Viita-Aho ..... B66B 7/047 188/165
6,318,505 B1 * 11/2001 De Angelis ..... B66B 11/0293 187/292
6,722,477 B1 * 4/2004 Wolfsteiner ..... B61H 5/00 188/173
7,896,139 B2 * 3/2011 Syrman ..... B66B 5/18 187/288
8,794,393 B2 * 8/2014 Argirovski ..... F16D 55/2245 188/196 D
9,145,282 B2 * 9/2015 Schautt ..... B66B 5/18

FOREIGN PATENT DOCUMENTS

DE 102011053178 B3 11/2012
FR 2670476 A1 * 6/1992 ..... B66B 5/18

* cited by examiner

FRICTION BRAKE HAVING AT LEAST ONE BRAKE LEVER WHICH IS MOUNTED ON A SOLID BODY JOINT

The invention relates to a friction brake according to the preamble of claim 1 and in particular to an electromagnetic friction brake for elevators.

Friction brakes known to the prior art such as those used for braking elevators, for example, comprise two oppositely arranged brake levers which are pressed against an interposed element, e.g. a brake rail, by means of an actuator, e.g. an electric motor. Such friction brakes have been on the market for a long time and although they are in principle perfected, they tend to squeak or jerk when the brake linings are applied to the element being braked. The resulting vibrations and noises are generally perceived as annoying and are unacceptable, especially in elevator technology.

Examples of friction brakes with two opposite brake levers, which are mounted on a solid body joint, are known from DE 29 10 118 A1, DE 10 2011 000 720 A1, or DE 10 2011 053 178 A1.

DISCLOSURE OF THE INVENTION

The object of the present invention is therefore to create a friction brake, in particular for elevators, which in normal operation works more smoothly, without annoying jerking movements or jolts. The friction brake of the invention can thus fulfill the function of a service brake and/or an emergency braking device.

According to the invention, this objective is achieved by the features listed in claim 1. Other embodiments of the invention emerge from the sub-claims.

According to the invention, a friction brake for braking a transport device, in particular an elevator, is proposed, which comprises at least one pivot-mounted brake lever with a brake lining as well as an actuator for actuating the friction brake, wherein the at least one brake lever is elastically suspended by means of a solid body joint. According to the invention, the solid body joint comprises at least one web to which the brake lever is fastened, wherein the web twists about its longitudinal axis when the at least one brake lever performs a pivoting movement. So that the solid body joint will not deviate in the lateral direction (clamping or releasing direction) or deflect laterally when the brake is actuated, the friction brake of the invention further comprises means or at least one element which limits or prevents a lateral deflection of the solid body joint.

The web is fastened on one or on both ends and preferably has a self-supporting section. The web structure can for example be laminated, i.e. formed out of one or more layers.

According to a preferred embodiment of the invention, the web has at least one narrower section with a smaller cross-section in which the torsional motion occurs.

The aforementioned element can comprise, for example, a lateral stop against which the solid body joint or the brake lever abuts when the brake is actuated and which thus limits the extent of lateral deflection. The lateral stop can be arranged directly adjacent to the solid body joint, for instance a web or a leaf spring, or at a slight distance of, say, a few millimeters, from the solid body joint. If the stop is arranged at a distance from a web, this has the advantage that the torsional motion of the web is not prevented. When the brake is actuated, however, the web will deflect slightly. When the stop is arranged directly adjacent to the web, however, the web will not deflect because it is already resting on a contact surface of the stop.

Said lateral stop can have a plate-shaped configuration, for example. However, it could also be configured as, say, a strut.

According to a specific embodiment of the invention, the lateral stop is part of a bracket that surrounds, for example, two struts or joint elements of a solid body joint arranged parallel to and at a distance from one another. The bracket is preferably dimensioned such that the two joint elements or webs can twist or bend freely and do not abut with the inner side of the bracket until the brake is actuated.

Alternatively or additionally, the elements can also comprise a connection element which connects the solid body joint, e.g. a web, to another component. The solid body joint is then mechanically coupled via the connection element to the other component, making it more rigid overall. The connection element can be configured as a strut or a bridge, for example.

In a solid body joint with two webs arranged parallel to one another, the connection element can be configured as, say, a type of cross-strut that connects the two webs to one another. The two webs are thus coupled together as a unit. The connection element can be an integral component of the solid body joint, for example. However, it can also be a separate component that is fastened subsequently to the two webs in order to couple the latter to each other.

According to a preferred embodiment of the invention, the solid body joint comprises at least two webs arranged parallel to and at a distance from another, with a brake lever fastened to each one, wherein the solid body joint is configured as a single piece. The solid body joint can have the shape of a frame, for example. The frame is preferably plate-shaped.

According to a specific embodiment of the invention, the at least one web can have at least one lateral recess. By means of this measure, the internal stress distributions in the solid body joint can be positively influenced such that internal stress peaks can be reduced, wherein the solid body joint deflects to a lesser extent. However, the web could also be completely interrupted, for instance in the center. In this case, two freely supported web parts (e.g. each measuring approximately half of the total length) would be situated of opposite sides of the gap thereby produced.

The solid body joint of the invention preferably has a laminated construction.

The twistable webs of the solid body joint are preferably configured in such a way that, in the released state of the friction brake, they pretension the brake lever or levers in the direction of release. Thus, even in the released state, the at least one brake lever is subjected to a force that tries to move it away from the braked element.

According to an embodiment of the invention, the solid body joint is arranged together with other components in such a way as to give rise to an enclosure, wherein the solid body joint forms a part, e.g. a lateral surface, of the enclosure. The other components of the enclosure can comprise, for example, another solid body joint, one or more frame parts, and/or one or more wall elements.

According to a preferred embodiment of the invention, the enclosure comprises at least two solid body joints which form, for example, opposing sides of the enclosure.

The enclosure can be used, for example, for housing various components of the transport device and/or of the brake in a protected manner. In this manner it is possible to dispense with, for example, individual component housings so that the weight of the transport device can be reduced.

In this context, the term "transport device" is understood to mean all devices that are moved along a solid track, e.g.

a guide rail. The term refers in particular to devices suited for transporting people or goods, either horizontally or vertically, and in particular to elevators, elevator cabs, conveyor paddles, conveyor systems, paternoster lifts, elevator cages, lifts, conveyor racks, lifting platforms or lifting systems, etc.

According to a specific embodiment of the invention, the friction brake comprises a brake caliper formed from two opposing brake levers, which grasps an interposed rail. At least one of the brake levers is pivot-mounted so that the brake lining, which is connected to the brake lever (via a brake shoe, for example), can be applied to a rail.

The elastic suspension is preferably designed such that the brake is held in a stable position in the non-actuated state on the one hand and such that the brake lever can be slightly deflected in the direction of movement of the transport device (or in the opposite direction, respectively) during the braking process on the other. The braking performance of the friction brake can thus be further optimized.

The elastic suspension and/or the solid body joint can also comprise a spring, e.g. at least one leaf spring. According to a specific embodiment of the invention, for each brake lever provision is made of a spring that engages with the respective brake lever. In this case the function of elastic suspension and the function of mounting the brake lever can be combined in a single component. The brake levers of a brake caliper can either be suspended individually or together.

The solid body joint, the suspension or its springs are preferably pre-tensioned in the direction of release of the friction brake. As a result, a force or a torque that facilitates the release of the brake linings from the friction surface acts on each of the brake levers.

In addition to their elastic suspension, the individual brake levers can also be pivotally mounted by a solid bearing. With this measure, the pivotal brake levers can pivot about a specified pivot axis. In a specific embodiment of the invention, for example, the brake lever is pivotally mounted on an end opposite the brake lining.

The brake levers are preferably mounted pivotally about parallel axes. The distance between the parallel pivot axes is preferably greater than zero, although identical pivot axes are also possible. This enables the bearing forces that arise in the direction of clamping during braking to distribute themselves evenly and cancel each other out and thus prevent an undesired lateral buckling of the elastic suspension.

In the case of an embodiment with brake calipers, provision can be made of a brake bridge between the opposing brake levers, which absorbs the clamping force arising during the braking process. The brake bridge is preferably suspended in a self-supporting manner by means of the elastic suspension. If the individual brake levers have (solid) bearings, they can be arranged, for example, on opposite sides of the brake bridge.

Provision is made of an actuator for actuating the friction brake. The friction brake of the invention further comprises a spring assembly, which pre-tensions at least one brake lever in the direction of the rail and is capable of automatically closing the brake, as well as a control that controls the actuator during the braking process in such a way that a clamping movement induced by the spring assembly is damped, at least in phases. By damping the clamping motion, less shock and vibration is introduced to the transport device. The brake therefore operates more smoothly and makes fewer objectionable squeaking noises.

According to a preferred embodiment of the invention, the actuator is controlled in such a way that the brake lining or linings are applied to the rail at a speed comparatively lower than they would be without the intervention of the actuator. The gentler application of the brake linings substantially improves the braking behavior of the friction brake.

In an initial phase of the clamping motion, the actuator is preferably controlled such that the brake lining or linings move faster towards the rail than they would without its support. This results in the earlier onset of the braking effect from the friction brake. In a subsequent second phase, the clamping movement is then preferably damped. The switch between the supporting and the damping operation of the actuator can take place, for example, when the brake lining or linings have crossed the clearance and come in contact with the rail. The switch can also occur either shortly before or after this point in time.

According to a preferred embodiment of the invention, the actuator is operated such that the clamping force increases essentially linearly during nearly the entire course of a braking process.

For example, the actuator can be fastened to a brake lever and can actuate at least one of the opposite brake levers in both the clamping and release directions. For releasing the brake, the actuator moves the brake levers apart, whereby the actuator loads the spring accumulator and the spring accumulator is recharged with potential energy. For holding a specific braking position, the actuator applies a constant force to the brake lever. For clamping, the actuator reduces its power, the clamping movement being effected by the pre-tensioning of the spring assembly.

According to a preferred embodiment of the invention, the brake comprises an adjustment mechanism with which the clearance of the friction brake and/or the pre-tensioning force of the spring assembly can be adjusted.

The friction brake of the invention preferably comprises an emergency braking device with which the friction brake can be automatically engaged in an emergency. The emergency braking function is preferably effected by the spring assembly. Emergencies are situations in which the proper operation of the system on which the brake is installed cannot be ensured, for instance the failure of the actuator in the event of a power outage or rupture of the cable by which the elevator cabin is suspended.

The emergency braking device preferably functions according to the following principle: If the electromechanical actuator stops working because of a power outage, it is no longer able to exert any force against the clamping force of the spring assembly. The spring assembly can thus press the brake shoe or shoes with the brake lining(s) against the rail, thereby automatically braking the transport device.

To this end, the spring assembly is configured such that it is able to bring the transport device from maximum speed or acceleration to a standstill regardless of the loading state, in particular even when it is fully loaded.

According to a specific embodiment of the invention, the friction brake can comprise a damping element that projects beyond the brake lining towards the rail. In this manner it is possible to keep the brake linings from rubbing on the rail and generating vibrations when the brake is open. Furthermore, the damping elements ensure an even distribution of the clearance between the brake linings and the element being braked. Moreover, the application of the brake linings to the element being braked or the rail is damped.

The actuator and the spring assembly can have a common housing, which can be mounted directly on a brake lever, for example.

The friction brake of the invention can be mounted on an elevator cab or on the counterweight of the elevator, for example.

BRIEF DESCRIPTION OF THE DRAWINGS

The invention is described in an illustrative manner in more detail in the following, with reference to the appended drawings. Shown are.

EMBODIMENTS OF THE INVENTION

Figure 1:
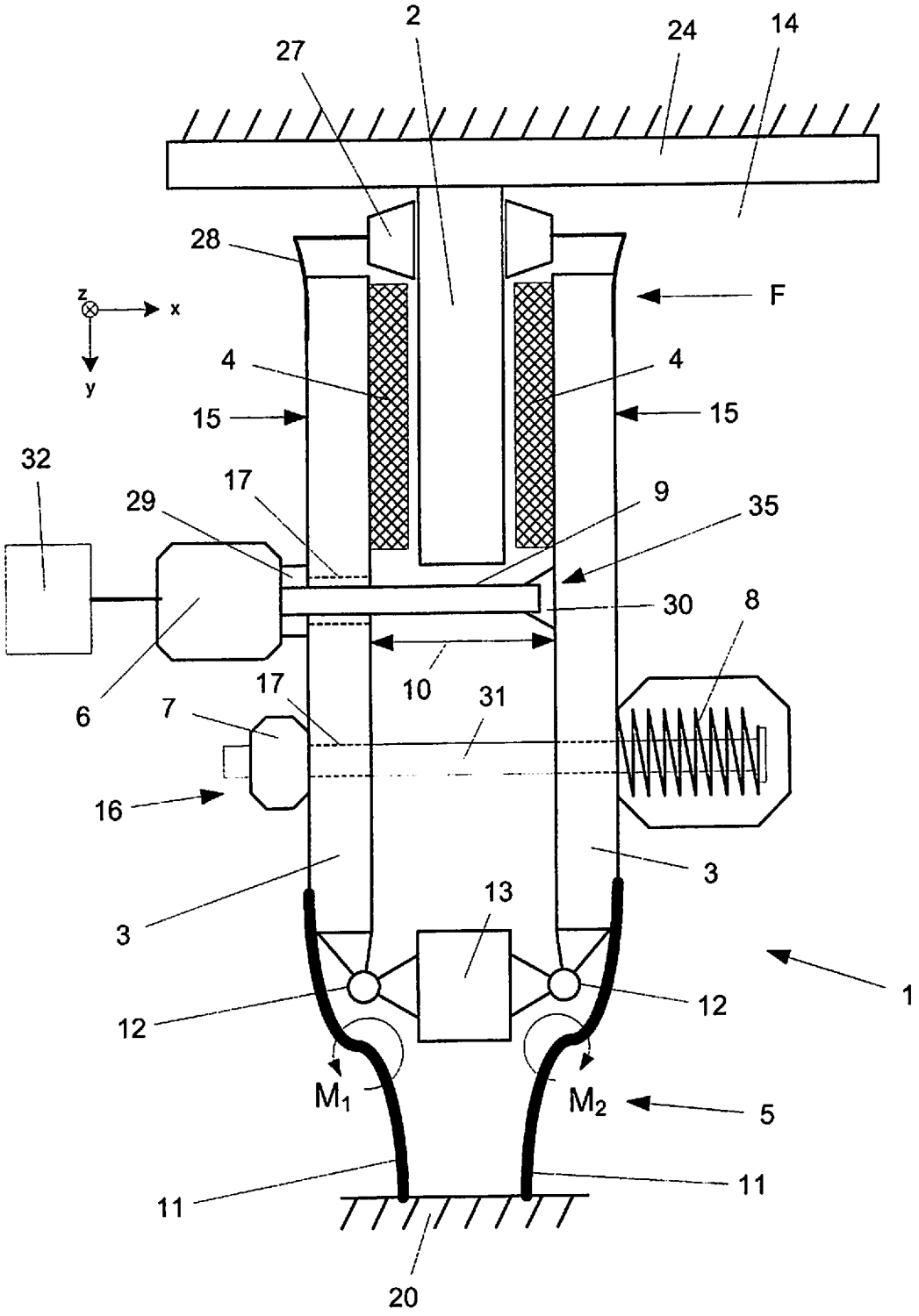
FIG. 1 a schematic view of a friction brake in a direction of movement z.

FIG. 1 shows a schematic view of a friction brake 1 with a clamping mechanism 15, which in this case comprises two pivotal brake levers 3. On a forward section, the brake levers 3 each have a brake shoe (not shown) with a brake lining 4. The brake linings 4 are preferably mounted on the brake shoes in a replaceable manner. Between the two brake levers 3 passes a friction element 2 (a guide rail in the present exemplary embodiment), which extends in a direction of movement (z direction) and to which the brake linings 4 can be applied in order to exert a braking force. The clamping mechanism 15 or the brake levers 3 thus form(s) a brake caliper, which grips the guide rail 2 from opposite sides. Alternatively, instead of the guide rail, the friction element 2 can be configured as a separate rail provided for the brake.

In the illustrated embodiment, the brake 1 is realized as an elevator brake with which the passenger cabin 25 (see FIGS. 2 and 3) of an elevator is braked. The brake 1 is mounted on a frame 20 of the passenger cabin 25 (see FIG. 2) and moves up or down with the passenger cabin 25, respectively, in the z direction. The guide rail 2 is fastened onto a wall 24 of the elevator shaft 14. Pressing the brake linings 4 against the guide rail 2 generates friction that decelerates the passenger cabin 25.

The brake 1 is suspended from the frame 20 of the passenger cabin 25 in a self-supporting manner by means of an elastic suspension 5. The elastic suspension 5 is advantageously produced as a solid body joint.

In this case, the solid body joint comprises two springs 11, which each attach to one of the brake levers 3. The springs 11 are advantageously pre-tensioned in the direction of the open position of the brake 1 so that they facilitate the release of the brake 1.

As can be discerned in FIG. 1, on end of each brake lever 3 opposite the brake lining 4, provision is made of a bearing 12 about which the brake levers 3 are pivotally mounted. The two bearings 12 are connected to one another via a brake bridge 13, which absorbs the forces arising during braking in the clamping and/or in the release direction (x direction). The brake bridge 13 can be a metal piece, for example.

In this case, the friction brake 1 is operated by means of two actuators, specifically by means of a spring assembly 8 and an electric motor 6. The spring assembly 8 can comprise, for example, several leaf springs; the electric motor 6 can be, for example, a brushless direct current motor.

The spring assembly 8 actuates a first anchor pull 16, which comprises an axle 31 that extends essentially in the clamping or release direction, respectively (x direction). In each brake lever 3, provision is made of a through-hole 17 through which the axle 31 is guided, wherein it projects outwards on both sides of the brake caliper. The spring assembly 8 is fastened on the end of the axle 31 shown on the right in the drawing and is braced against the right brake lever 3. The shaft 31 is secured on the other side of the brake caliper by a nut 7.

The spring assembly 8 is pre-tensioned and exerts a force F that closes the brake 1. The spring assembly 8 is thus capable of automatically braking the elevator or keeping it stationary in all operating states, in particular, even when it is loaded to maximum capacity.

In this embodiment, the friction brake 1 comprises a second anchor pull 35, which is actuated by the electric motor 6. The second anchor pull 35 comprises a shaft 9, which is driven by the electric motor 6 and extends essentially in the clamping or release direction, respectively (x direction). The shaft 9 passes through an opening 17 with an inner thread provided in the brake lever 3 shown on the left and is rotatably mounted by means of a bearing 30 on its end opposite the electric motor 6. The shaft 9 has, at least in the vicinity of the opening 17, a corresponding outer thread that engages with the inner thread of the opening 17. Depending upon the rotational direction of the shaft 9, the distance 10 between the two brake levers 3 can be either increased or decreased.

Alternatively, the shaft 9 can be configured as a ball-screw drive, which converts the rotary motion of the motor into an axial longitudinal motion. For this purpose the bearing 30 can be configured as a nut so that the right brake lever 3 is actuated. The motor 6 can be fastened to the left brake lever 3 via the linkage 29.

The electric motor 6 is controlled by a control unit 32. In the illustrated open position of the friction brake 1, the electric motor 6 must be operated at a certain power in order to hold the friction brake open against the force of the spring assembly 8. To execute a braking process, the motor power is reduced so that the opposite brake levers 3 move towards one another and the brake linings 4 are pressed against the guide rail 2. In doing so the clamping movement induced by the spring assembly 8 is damped, at least in phases, by the electric motor 6 so that the brake linings 4 close against the guide rail 2 at a lower speed than they would without the engagement of the electric motor 6. Vibrations of the transport device can be lessened by the gentle application of the brake linings 4. Furthermore, the elastic suspension 5 of the brake caliper likewise helps improve the braking behavior.

Over the course of the operation of the friction brake 1, the clearance or the clamping force acting in the engaged state of the brake, respectively, can change as a result of wear. The freeplay and/or the clamping force can be adjusted by an appropriate actuation of the nut 7. In this case the nut 7 is a component of an adjustment mechanism with which the distance 10 between the two brake levers 3 can be decreased or increased. In an advantageous manner, the travel of the brake levers thus remains constant and as a result the spring accumulator applies a uniform pressing force to the brake levers in the engaged state of the brakes.

As an alternative, the adjustment device could also be provided on the brake bridge 13. In this case, for example, the distance between the two bearings 12 would be alterable.

As an alternative, provision could be made of just one anchor pull, which is actuated by both the spring assembly 8 and by the electric motor. In this case, for example, the spring assembly 8 could be arranged between the electric motor and the closest brake lever 3.

Along with its function as an actuator device for the friction brake 1 in normal operation, the spring assembly 8 also simultaneously functions as an emergency braking device with which the brake can be braked in an emergency such as a power outage or rupture of the elevator cable. If the electric motor 6 stops working during a power outage, it can no longer restrain the clamping force exerted by the spring assembly 8 and the friction brake 1 engages automatically as a result. In this case the shaft 9 must be designed as non-self-locking and must be able to rotate in response to the clamping force exerted by the spring assembly 8 in order to allow the brake levers 3 to close.

In other emergencies such as a cable break, the friction brake 1 can be engaged faster and with greater force by a joint actuation of the brake by means of the spring assembly 8 and the electric motor 6.

Figure 2:
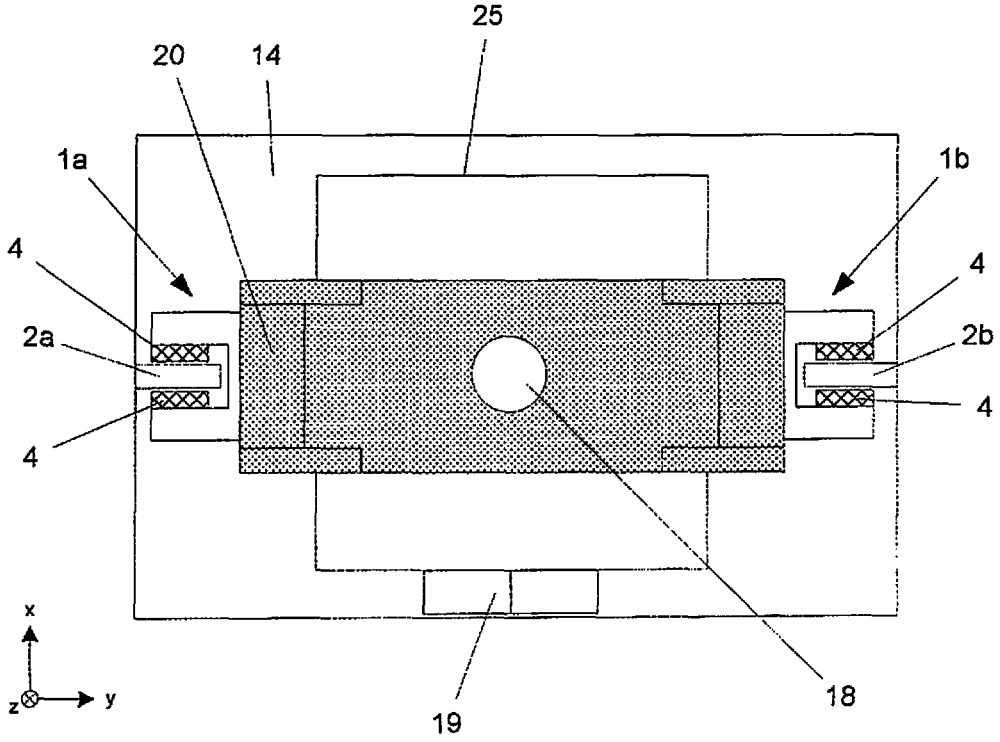
FIG. 2 a view from above of a passenger cab of an elevator.

FIG. 2 shows a view from above of an elevator passenger cabin 25 in an elevator shaft 14. The passenger cabin 25 comprises a frame structure 20 constructed from, for example, a welded metal frame, which is suspended centrally at a connection point 18 on a cable 22 (see FIG. 3). The actual cabin 25 is arranged in the interior of the frame structure 20, wherein damping elements 21 that provide better riding comfort are arranged between the cabin 25 and the frame structure 20. The passenger cabin 25 can be entered and exited via a sliding door 19.

The passenger cabin 25 is guided in its direction of movement (z direction) by two guide rails 2*a*, 2*b*, which extend in the z direction on opposite sides of the cabin 25. The passenger cabin 25 is provided with a brake 1 on each guide rail 2*a*, 2*b* side, as shown in FIG. 1. The elevator is thus guided along the guide rails 2*a*, 2*b* and can simultaneously be braked.

Figure 3:
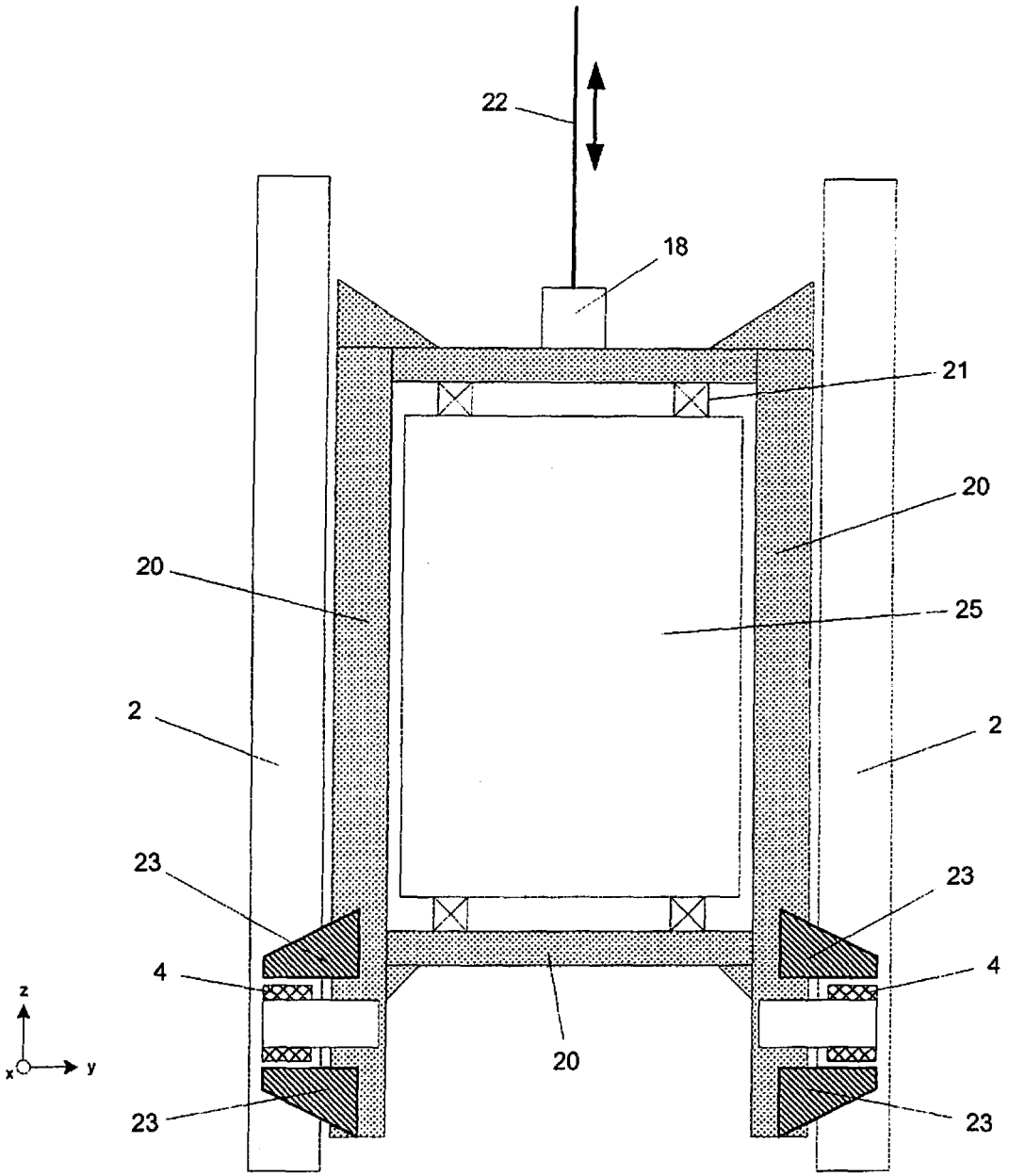
FIG. 3 a side view of the passenger cab of FIG. 2.

FIG. 3 shows a side view of the elevator of FIG. 2. As can be discerned, the brakes 1 are arranged in a bottom region of the frame structure 20, wherein provision is made of a stop 23 on each of both sides of each brake 1.

Owing to the elastic suspension 5 of the brake levers 15, during a braking process the latter are deflected slightly by the guide rail 2. When the passenger cabin 25 goes up, the brakes 1 are deflected downwards (i.e. against the direction of movement of the passenger cabin 25), and vice versa. In order to restrict this movement of the brake levers 15 and in particular to prevent the elastic suspension 5 from buckling excessively or even breaking, several stops 23 are provided here, which are each arranged at a slight distance from the brake levers 15. If the braking forces acting on the brakes 1 are strong, the brake levers 15 come into abutment with the lateral stops 23 and their movement is thus restricted. Here the stops 23 are fastened onto the frame 20.

The rigidity of the suspension 5 of the brake levers 15 and the position of the stops 23 are preferably adjusted in relation to each other in such a way that the brake levers 3 or the brake linings 4 only come into abutment with the stops 23 during heavy braking, but not during weaker braking.

Figure 4:
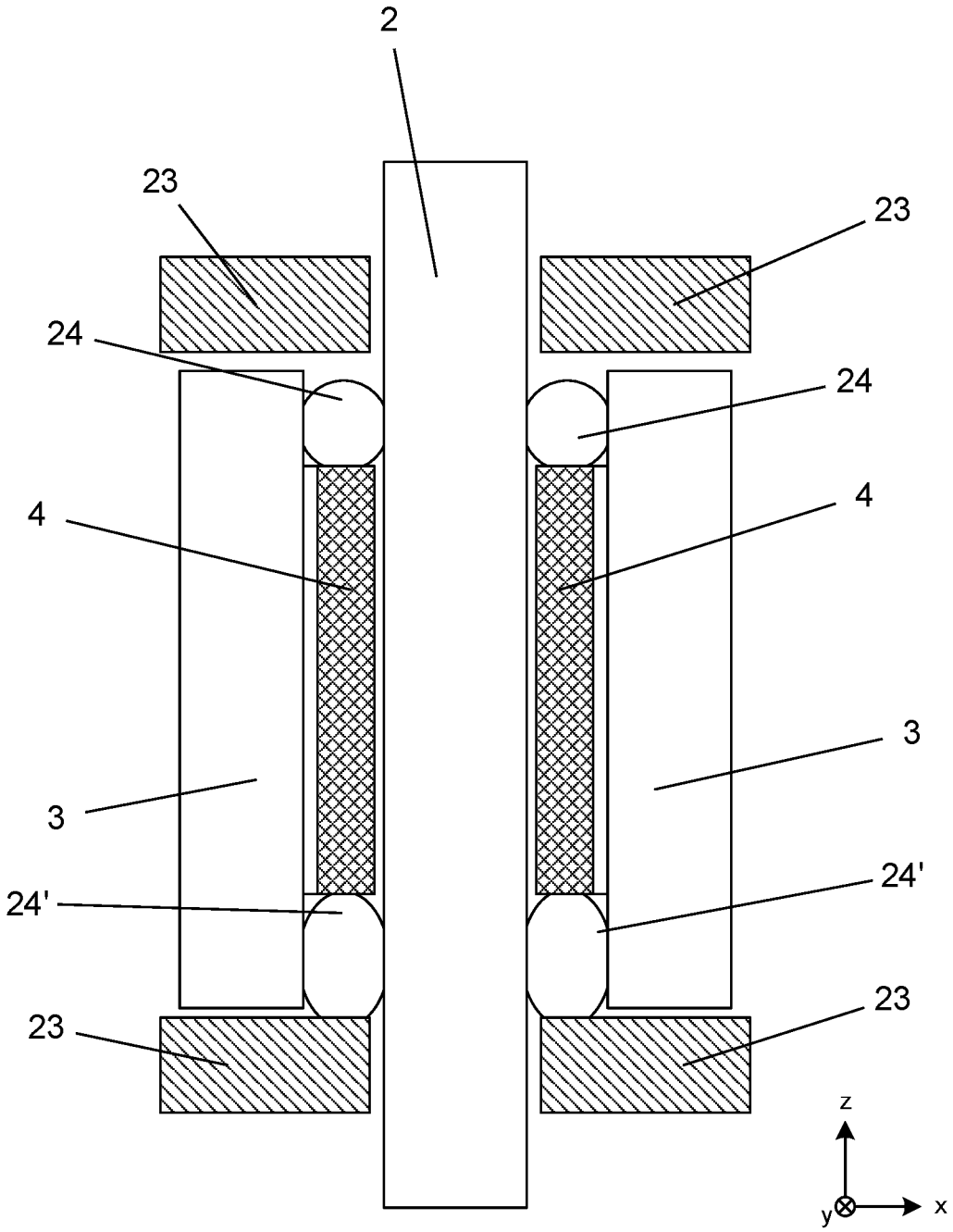
FIG. 4 a specific embodiment of a friction brake with damping elements.

FIG. 4 shows a side view of the brake 1 of FIG. 1 in a plane perpendicular to the plane of the drawing. The brake 1 illustrated here comprises several damping elements 24 and 24' made of an elastic (e.g. rubber-like) material.

The damping elements 24 are each fastened onto the brake levers 3 (or brake shoes (not shown)) laterally to the brake linings 4 and project in the clamping direction (x direction) past the brake lining 4 towards the guide rail 2. In the exemplary embodiment illustrated, one damping element 24 is provided per brake lever 3. However, more damping elements 24 per brake lever 3 can also be provided.

The damping elements 24 essentially serve to keep the brake linings 4 from scraping on the guide rail 2 in the released state of the brake. Furthermore, the damping elements 24 ensure uniform clearance (play) between the brake linings 4 and the guide rail 2.

The damping elements 24 or 24' can be made of a rubber-like material or contain such a material. The elasticity of the damping elements 24 is preferably set such that the force needed for engaging the brake 1 is not substantially greater than it would be without damping elements 24.

The damping elements 24' are likewise fastened onto the brake levers 3 laterally to the brake linings 4. However, they project past the brake levers 3 in the direction of the stops 23 (z direction). An impact of the brake levers 3 against the laterally arranged stops 23 can thus be damped.

Optionally, it is also possible for the damping elements 24' to be arranged on both sides of the brake linings 4. Provision can be made of one or a plurality of damping elements 24' per side.

FIG. 1 shows another embodiment of the damping elements 24, in which a damping element 27 is fastened onto the brake lever 3 by means of an elastic element 28.

Figure 5A:
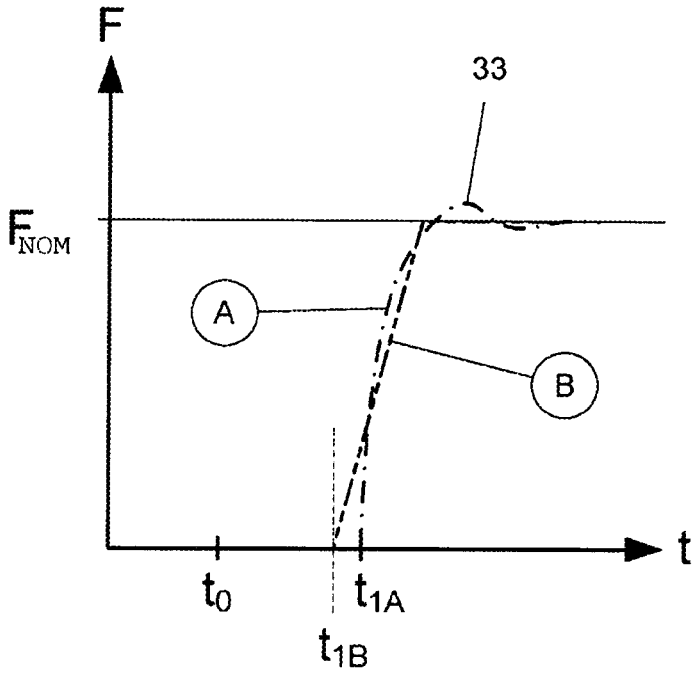
FIG. 5*a, b* the progression of the clamping force F and of the path traveled by the brake shoe with time during a braking process.

FIG. 5*a* shows the progression of the clamping force F over time during a braking process of the friction brake 1. The characteristic curve A shows the progression of the clamping force during a braking process that is effected solely by the spring assembly 8. The characteristic curve B shows the progression of the clamping force during a braking process in which the spring assembly 8 and the electric motor 6 are both engaged.

The braking process starts at a point in time $t_0$; the clearance is overcome at the point in time $t_{1A}$ or $t_{1B}$, respectively, and the brake linings 4 are applied to the guide rail 2. As can be discerned, this state is reached faster in a braking process with electric motor support (characteristic curve B) than it is in a braking process without electric motor support (characteristic curve A). This is achieved by the fact that at the start of the braking process, the electric motor 6 is driven in the clamping direction so that the brake levers 3 move towards the guide rail 2 faster.

After the brake linings 4 contact the guide rail 2, the clamping force is increased essentially linearly by controlling the motor 6 accordingly until a nominal clamping force $F_{NOM}$ is reached and is then held at this level. In contrast, in a purely mechanical braking driven by the spring assembly 8, the clamping force F builds up faster, causing the brake linings 4 to impact the guide rail 2 with greater force. In the center area, the characteristic curve A shows a clearly greater slope. The brake levers 3 consequently start to vibrate, which is the cause of squeaking noises or jerky movements.

Upon reaching the nominal clamping force $F_{NOM}$ in the case of characteristic curve A without electric motor support, the clamping force is overshot owing to the inertia of the brake levers and the brake linings. In the case of characteristic curve B however, this overshoot can be effectively prevented through the interaction of the actuator 6 and the spring assembly 8.

Figure 5B:
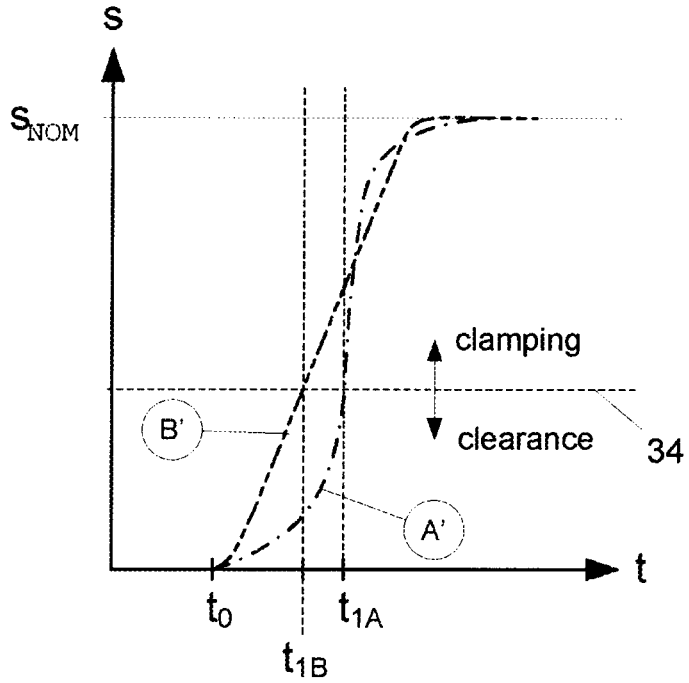

FIG. 5*b* shows the temporal progression of the travel path s of the brake levers 3 during the braking, wherein the characteristic curve A' shows the progression without electric motor engagement and the characteristic curve B' shows the progression with electric motor support.

As can be discerned, the brake levers 3 move over nearly the entire travel path $S_{NOM}$ at an essentially constant speed, whereas in an initial phase in a purely mechanically driven braking A', the brake levers 3 at first move more slowly and then much faster than in characteristic curve B'. At the point in time $t_{1A}$ or $t_{1B}$, respectively, the clearance of the brakes is overcome and the brake levers 3 come into contact with the guide rail 2. The travel path s on which the brake linings 4 come into contact with the guide rail 2 is indicated with a dashed line 34. In this state the speed with which the brake linings 4 impact the guide rail 2 is considerably less in characteristic curve B' than in characteristic curve A'. Characteristic curve A' has a distinctly greater slope than characteristic curve B'. Therefore, according to characteristic curve B', the jolt caused by the impact of the brake linings is likewise less intense.

In purely mechanically driven braking (characteristic curve A'), the speed of the brake levers 3 eventually decreases because the spring assembly 8 loses tension. According to characteristic curve B' on the other hand, the brake levers 3 are still being driven at a constant speed and cover the nominal travel path $S_{NOM}$ sooner than in characteristic curve A'.

By properly controlling the electric motor, it is thus possible to cushion the clamping movement of the brake levers 3 induced by the spring assembly 8 and in particular to apply the brake levers 3 to the guide rail 2 with a lower speed. If the electric motor 6 is controlled in such a way that the brake levers 3 move comparatively faster, at least in an initial phase of a clamping movement, it is possible to achieve a desired nominal clamping force in the same time or even sooner than with purely mechanically driven braking.

Along with its function as a service brake and an emergency brake, the brake illustrated in FIGS. 1 through 4 can also be used as a safety brake with which it is possible to prevent undesired movements of the passenger cabin 25, such as those that occur during the boarding or exiting of passengers. For example, the brake 1 can be engaged by the control 32 while the elevator is at a standstill. Furthermore, the elevator brake 1 can also be used for maintaining a specific speed profile at the top or bottom end of the shaft or for ensuring that a safety space needed for performing maintenance work, for example, is maintained above or below the elevator cab. To this end, the motor 6 of the brake 1 is controlled accordingly by the elevator control 32.

Figure 6:
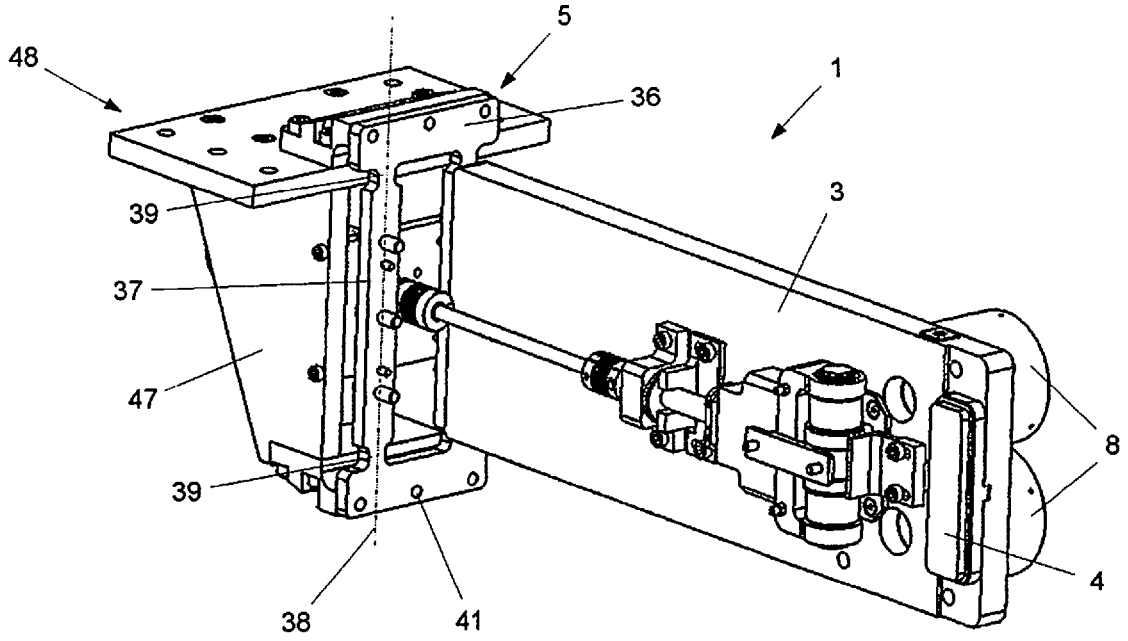
FIG. 6 a lateral, perspective view of a friction brake.

FIG. 6 shows a perspective view of a friction brake 1 according to a second embodiment of the invention. The friction brake 1 comprises two oppositely arranged, pivot-mounted brake levers 3, of which only one brake lever 3 is illustrated for the sake of clarity. The brake levers 3 are elastically suspended by means of a special solid body joint 36. In this case the solid body joint 36 has two parallel webs 37, onto each of which a brake lever 3 is fastened by means of, say, a screw connection.

In each case, the webs 37 are fastened at their two ends and have a self-supporting section in the middle. In the vicinity of each web end, provision is made of a constricted section 39 where the webs 37 can twist. When the brake levers 3 perform a pivot movement in the clamping or release direction (x direction) in response to an actuation of the brake 1, the webs 37 twist about their longitudinal axes 38. This causes an internal stress which acts as a spring and attempts to return the brake levers 3 to their original position to build up in the solid body joint 36. In other words the solid body joint 36 has the properties of a mechanical spring.

In this case, the webs 37 are connected to each other and thus form a single-piece solid body joint 36. The solid body joint 36, including the webs 37, can be made of metal, for example. In a particular embodiment, the solid body joint 36 can be configured as a laminated construction.

The solid body joint 36 and the webs 37 are preferably designed such that they do not exert any force on the brake levers 3 in the open position of the friction brake 1. As an alternative, however, they can also be designed in such a way that they pre-tension the brake levers 3 in the release direction when the brake 1 is in the open state.

The distance between the parallel pivot axes 38 is preferably greater than zero. As a result, the bearing forces that arise in the clamping direction during braking are evenly distributed and can cancel each other out, thus avoiding an unwanted lateral buckling of the elastic suspension 5.

The elastic suspension 5 or the solid body joint is furthermore designed such that the brake 1 is held in a stable position in the unactuated state on the one hand, and the brake levers 3 during a braking process can be deflected slightly against the direction of movement of the transport device on the other. This is achieved here by a certain elasticity of the solid body joint 36.

Figure 7:
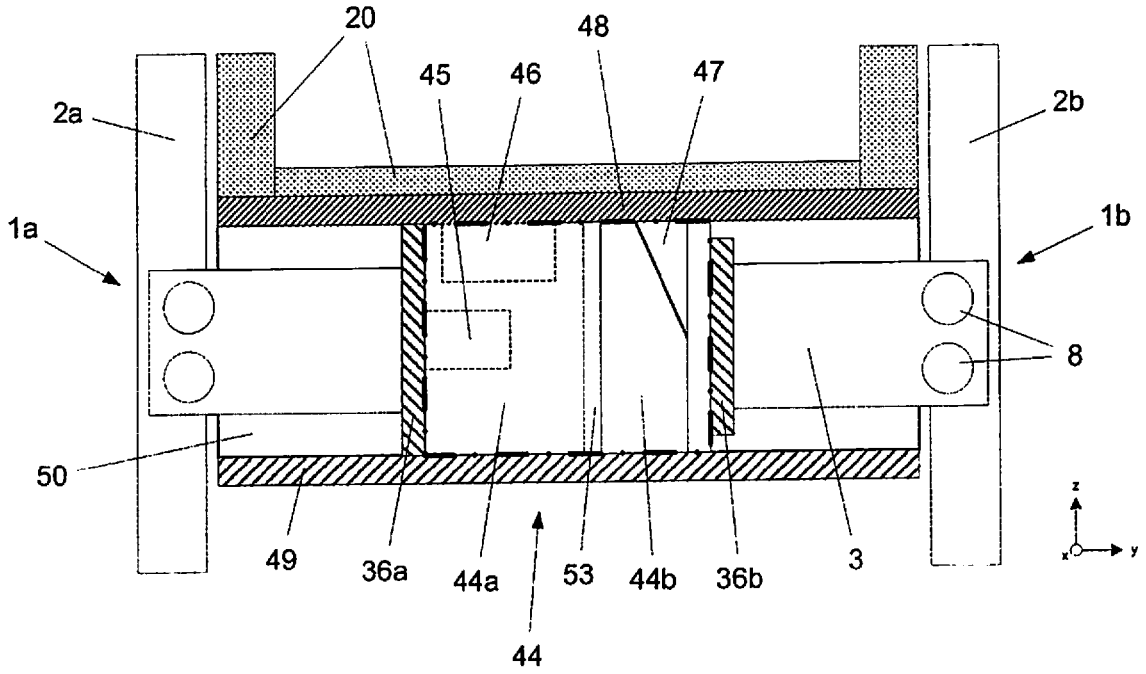
FIG. 7 a side view of two brakes fastened to the transport device.

FIG. 7 shows the bottom area of a passenger cabin 25 with two brakes 1*a*, 1*b*, wherein one brake 1*a* engages on the left guide rail 2*a* and the other brake 1*b* engages on the right guide rail 2*b*. In this manner, the braking forces can be distributed evenly on the left and right so that, for example, a tipping or lopsided pulling of the passenger cabin 25 can be avoided during a braking process. It is also possible to use more than two brakes, but when doing so it is necessary to ensure that the sum of the braking forces is as evenly distributed as possible on the left and right.

For fastening the brakes 1*a* and 1*b* onto the passenger cabin 25, use is made of an upper 48 and a lower frame part 49, wherein the upper frame part 48 is rigidly connected to the frame 20 of the passenger cabin 25. As an alternative, the brakes 1*a* and 1*b* could also be fastened on top of the passenger cabin 25. The two brakes 1*a* and 1*b* comprise a solid body joint 36*a* and 36*b*, respectively, which are oppositely arranged. The solid body joints 36*a* and 36*b* can either be mounted directly or indirectly, by means of another component, on the frame parts 48, 49 or optionally also on other components.

In the illustrated embodiment, for fastening the solid body joints 36*a*, 36*b* provision is made of a plurality of screws (not shown), which are screwed into corresponding threaded holes 41 in the solid body joint 36 and in the frame part 48/49, respectively. The solid body joints 36*a*, 36*b* can also be fastened by means of an additional structural element 47, which, for example, can have ribs for bracing the connection. In the illustration of FIG. 7, the right solid body joint 36*b* is fastened onto the structural element 47, whereas the left solid body joint 36*a* is joined directly to the frame part 48 and/or 49.

The solid body joints 36*a*, 36*b* are arranged oppositely at a distance from each other and either alone or together with the upper and/or lower frame section 48, 49 form a (partially open) enclosure 44, which is outlined in a boldface dashed/ dotted line for clarity. The lateral surfaces of the enclosure 44 are formed by the solid body joints 36*a*, 36*b* and optionally other components.

The interior space delimited by the enclosure 44 can be used for integrating and/or protecting individual components of the brake, for example. For example, the drive 45 of the brake could project, at least partially, into the space and/or be fastened therein. It is also possible to integrate the control 46 of the brake into this space. Components needed for the elevator system such as sensors or control units can also be integrated into this space. The enclosure 44 can therefore be used as a housing for diverse components. Hence an additional component housing can be dispensed with, thus lessening the weight of the transport device 26.

For bracing and/or compartmentalizing the enclosure 44, provision can be made of one or a plurality of (partition) walls 53. In this manner, the at least partially enclosed space can be subdivided into (separate) subspaces 44*a* and 44*b*. In other words, the space can be composed of several subspaces 44*a* and 44*b*.

Figure 9:
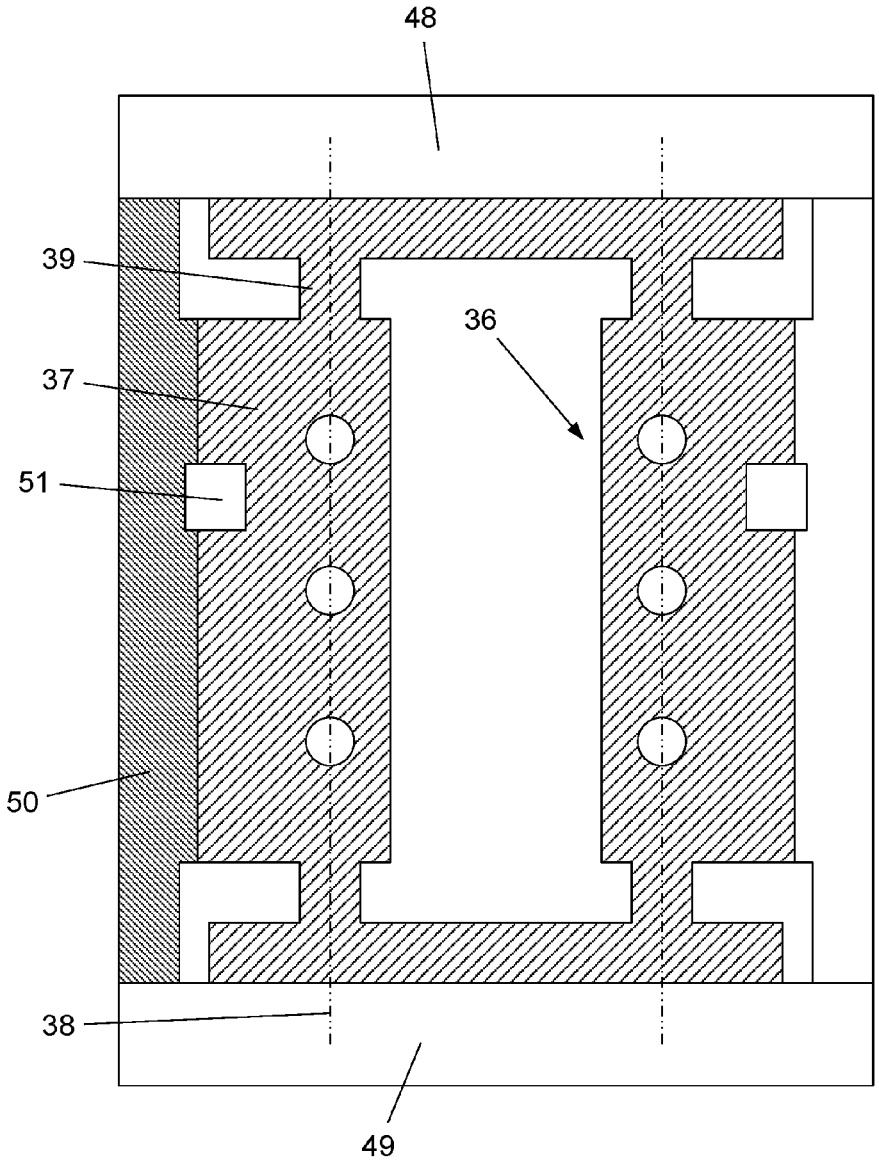
FIG. 9 a schematic frontal view of an enclosed solid body joint.

In order to enclose the space further, additional components (e.g. 47, 50) can be mounted on the aforementioned components (e.g. 36*a*, 36*b*, 48, 49), as shown in FIGS. 7 and 9. As an alternative or in addition to the fastening of the solid body joint 36 onto the upper frame part 48, 49, the solid body joint 36 can be fastened onto the side enclosing element (50). The aforementioned components 36*a*, 36*b*, 47, 48, 49, 50 can be used as such for enclosing the space 44. This gives rise to an at least partially enclosed space 44 that is formed from the at least two oppositely arranged solid body joints 36*a*, 36*b* and from an upper enclosing element 48 and/or a lower enclosing element 49 and/or a side enclosing element 50. In other words, the space 44 can thus be delimited or enclosed on all sides.

Furthermore, the frame 20 and the upper and/or lower enclosing elements 48/49 can be configured as one piece. Furthermore, the upper and/or lower and/or lateral enclosing elements can also be configured as one piece, for instance as a U profile.

Figure 8:
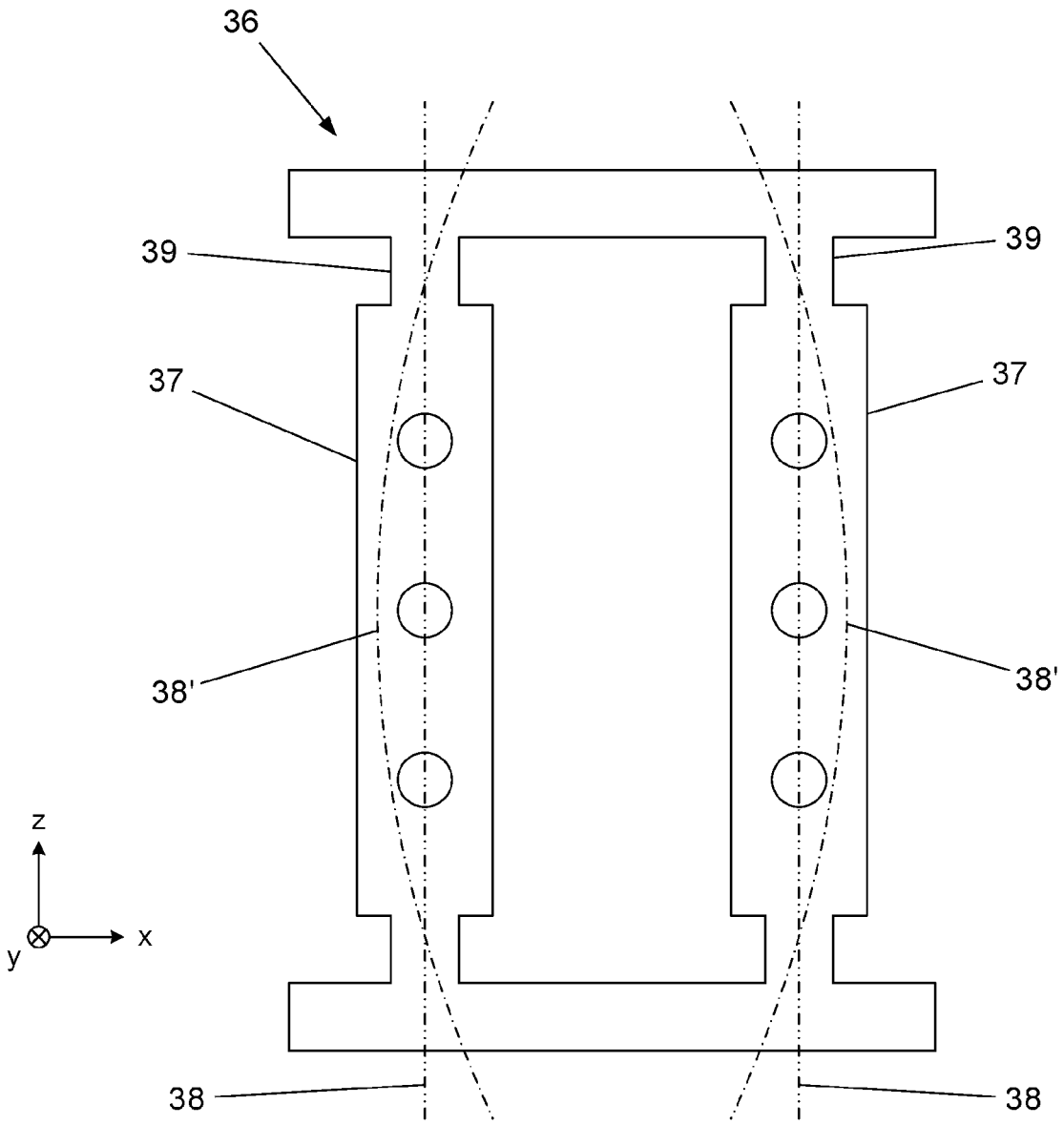
FIG. 8 a schematic frontal view of a solid body joint.

The brake levers 3 mounted on the solid body joint 36 advantageously should not buckle under the forces exerted upon engaging the brake 1. In other words, the pivot axes 38 of the solid body joint 36 should always run parallel to one another. As indicated in FIG. 8, however, when the brake levers 3 engage and generate a heavy load, the webs 37 of the solid body joint 36 can bend laterally (i.e. in the release direction) in such a way that the pivot axes 38' deflect and no longer run parallel to each other.

According to the invention, the friction brake 1 therefore comprises means or elements (e.g. 42, 50, 52) that limit or prevent a lateral deflection of the solid body joint. In the embodiment illustrated in FIG. 9, these means each comprise a lateral stop 50 against which the web 37 in question abuts when the brake is actuated. The stop 50 thus limits the extent of lateral deflection.

The lateral stop 50 can be arranged directly adjacent to the web 37 or at a slight distance of, say, a few millimeters from the web 37. If the stop 50 is arranged at a distance from the web 37, the twisting motion of the web 37 will not be hindered. However, the web 37 will deflect slightly when the brake is actuated. On the other hand, if the stop 50 is arranged directly adjacent to the web 37, the web 37 will not deflect because it is already in abutment with a contact surface of the stop 50.

Because the lateral stops 50 do not have to fulfill any other functions (e.g. twisting), they can be configured sufficiently rigid so as not to bend under the influence of lateral forces.

The lateral stop 50 is plate-shaped here, but it could also be configured as a type of strut, or rod. The lateral enclosing element 50 is advantageously used as a lateral stop 50.

In FIG. 9, the webs 37 have a special recess 51, which narrows the cross-section of the webs 37 in a middle section, said cross-section being decisive for deflection. A positive influence is thus exerted on the force distribution and/or the internal stresses in the web 37. Optionally, provision can also be made of a plurality of recesses 51. In addition, the lateral stop 50 can also have one or a plurality of recesses. Connecting the stops 50 to the upper and/or lower enclosing elements 48, 49 conveys additional stability.

Figure 10:
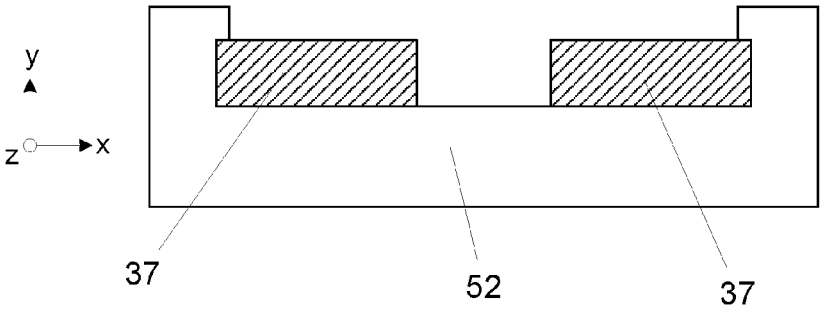
FIG. 10 a top view of a bracket for the webs of the solid body joint.

FIG. 10 shows a second embodiment of the element for preventing or limiting a lateral deflection of the webs 37. In this case, the latter comprise a bracket 52, which holds two webs 37 arranged parallel to and at a distance from each other. The bracket 52 is preferably dimensioned such that both webs 37 are free to twist and do not abut with the inner side of the bracket until the brake is actuated. However, the bracket could also be designed in such a way that the webs 37 are already in abutment with the inner surface of the bracket 52 in the unactuated state.

The bracket can engage in, for instance, a recess 51 (see FIG. 9) of the webs 37. In this manner it is securely positioned on the webs 37 and cannot slip or detach. Advantageously, the bracket 52 grips the webs 52 approximately in the middle, which is where the lateral deflection is the largest.

Provision of the bracket 52 can also be made in addition to the stops 50 and/or other means.

Figure 11:
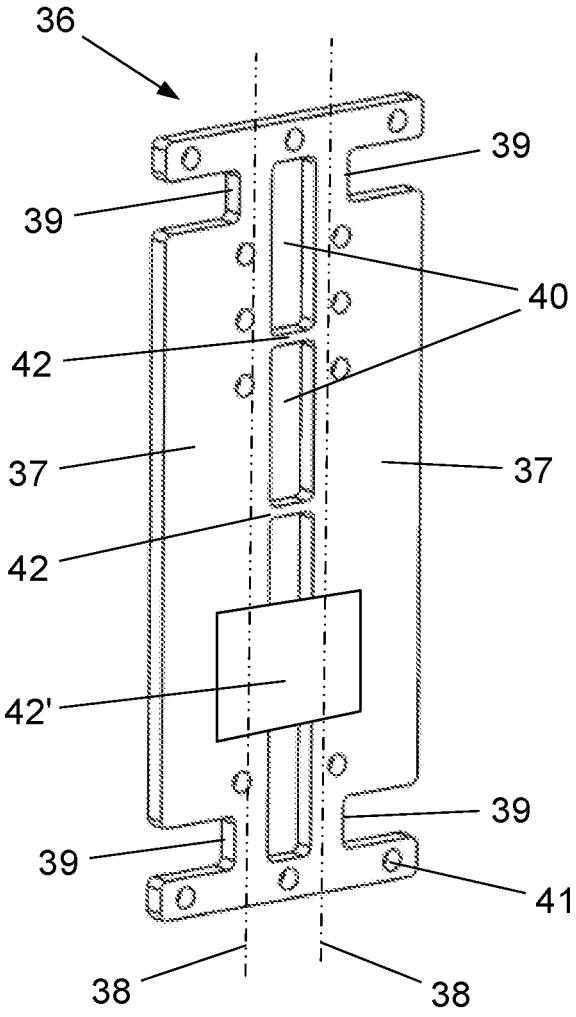
FIG. 11 a perspective view of a solid body joint.

FIG. 11 shows a third embodiment of the means for preventing or limiting a lateral deflection of the webs 37. In this case the latter comprise one or a plurality of connecting elements 42, 42' in the form of cross-struts or bridges that connect the webs 37 to one another on their self-supporting sections. The connecting elements 42 thus constitute an integral component of the solid body joint 36 and are advantageously configured such that they only marginally restrict the twisting motion of the webs 37 about the pivot axis 38.

As an alternative, the connecting element 42' could also be configured as a separate structural element that is subsequently fastened to the webs 37. For example, the connecting element 42' can be configured as a thin plate that allows a twisting motion of the webs 37 but prevents a lateral deflection. For example, the separate structural element can be bolted, glued, or welded to the webs 37. If hollow spaces 40 arise between the two webs 37, the former can be filled with an elastic sealant such as silicone.

As an alternative or in addition, provision can be made of a connecting element 42 that connects one web 37 to another component such as the lateral stop 50. In this case the web 37 would be mechanically coupled to the other component via the connecting element 42, which would make the web 37 more rigid overall.

Furthermore, a combination of several means can be used for bracing the webs 37. For example, the lateral enclosing elements 50, the bracket 52, and also the brace elements 42 (e.g. cross-struts) can be used in any combination for preventing the lateral deflection of the struts 37.

The invention claimed is:

1. Friction brake (1) for braking a transport device (26), comprising at least one pivotally arranged brake lever (3) with a brake lining (4), which is elastically suspended by means of a solid body joint (36), and further comprising an actuator (6) for actuating the friction brake (1), wherein the solid body joint (36) has at least one web (37) comprising a self-supporting section to which the brake lever (3) is fastened and having two ends which are fixed, so that the web (37) twists about its longitudinal axis (38) when the brake lever (3) performs a pivoting movement, and further comprising an element (42, 42', 50, 52) which limits or prevents deflection of the web (37) in a lateral direction (x).

2. Friction brake (1) according to claim 1, wherein the element (42, 42', 50, 52) comprises a lateral stop (50, 52).

3. Friction brake (1) according to claim 2, wherein the lateral stop (50, 52) is configured as a plate.

4. Friction brake (1) according to claim 2, wherein the lateral stop (50, 52) is part of a bracket (52), which holds two webs (37) arranged parallel to and at a distance from each other.

5. Friction brake (1) according to claim 1, wherein the element (42, 42', 50, 52) comprises at least one connecting element (42, 42'), which connects the web (37) to another component (37, 47).

6. Friction brake (1) according to claim 5, wherein the connecting element (42) is configured as a bridge or a web.

7. Friction brake (1) according to claim 5, wherein the connecting element (42) connects a first web (37) to a second web (37) arranged in parallel.

8. Friction brake (1) according to claim 5, wherein the connecting element (42) connects a first web (37) to a laterally positioned structural element (47).

9. Friction brake (1) according to claim 1, wherein the solid body joint (36) comprises two webs (37) arranged parallel to and at a distance from each other, to each of which is fastened one brake lever (3), wherein the solid body joint (36) is formed from a single piece.

10. Friction brake (1) according to claim 1, wherein the solid body joint (36) pre-tensions the brake lever or levers (3) in a release direction when the brake (1) is in a released state.

11. Friction brake (1) according to claim 1, wherein the solid body joint (36) is arranged together with other components (47, 48, 49) so as to form an enclosure (44), wherein the solid body joint (36) forms a part of the enclosure (44).

12. Friction brake (1) according to claim 1, wherein there is provided an enclosure (44) which is defined by at least two solid body joints (36) that form opposite lateral surfaces of the enclosure (44).

13. Friction brake (1) according to claim 1, wherein the web (37) has a recess that narrows an effective cross-section of the web (37).

14. Friction brake (1) according to claim 1, wherein the friction brake (1) comprises a spring assembly (8), which pre-tensions at least one brake lever (3) in a clamping direction (x), wherein the actuator (6) is controlled by a control unit (32) in such a way that a clamping movement of the friction brake (1) effected by the spring assembly (8) is damped, at least in phases.

* * * * *